US005870897A

United States Patent [19]

Barr et al.

[11] Patent Number: 5,870,897

[45] Date of Patent: Feb. 16, 1999

[54] REFRIGERATED CONTAINER

[75] Inventors: Michael Barr, Farnborough; Stephen N. Waldron, Lingfield; Michael E. Garrett, Woking, all of England

[73] Assignee: The BOC Group plc, Windlesham, England

[21] Appl. No.: 881,995

[22] Filed: Jun. 25, 1997

[30] Foreign Application Priority Data

Jun. 26, 1996 [GB] United Kingdom ..... 9613421

[51] Int. Cl.[6] ..... F17C 7/02

[52] U.S. Cl. ..... 62/52.1; 62/434; 62/457.9

[58] Field of Search ..... 62/52.1, 434, 457.2, 62/457.9, 239

[56] References Cited

U.S. PATENT DOCUMENTS

| | | | |
|---|---|---|---|
| 3,241,329 | 3/1966 | Fritch, Jr. et al. | 62/52.1 |
| 3,287,925 | 11/1966 | Kane et al. | 62/239 |
| 3,308,630 | 3/1967 | Fritch, Jr. et al. | 62/239 |
| 3,363,425 | 1/1968 | Williamson | 62/239 |
| 3,385,073 | 5/1968 | Snelling | 62/52.1 |

FOREIGN PATENT DOCUMENTS

| | | |
|---|---|---|
| 859518 | 10/1958 | United Kingdom . |
| 1268967 | 6/1969 | United Kingdom . |
| 1242626 | 11/1969 | United Kingdom . |

*Primary Examiner*—Ronald Capossela
*Attorney, Agent, or Firm*—William A. Schoneman; Salvatore P. Pace

[57] ABSTRACT

A refrigeration apparatus includes a container in which are situated a plurality of eutectic chilling elements and a spraybar for dispensing a mist of liquid cryogen into a region R in which product to be refrigerated is to be stored. Liquid cryogen is used to freeze the eutectic and is then passed to the spray bar.

10 Claims, 3 Drawing Sheets

REFRIGERATED CONTAINER

The present invention relates to a refrigeration apparatus and relates particularly, but not exclusively to such an apparatus for use in vehicles.

BACKGROUND OF THE INVENTION

Many vehicles engaged in the distribution of foodstuffs maintain refrigeration of the vehicle by means of eutectic plates. Essentially these are metal tanks filled with a eutectic, which is a mixture which freezes or melts at a constant temperature, those in use normally being operated at between about minus 20° C. and 0° C. to cover chilled and frozen foods. The vehicles utilizing these plates are typically well insulated and the plates will maintain the interior of the vehicle at the proper temperature for several hours. After this time, the plates are re-frozen by circulating a refrigerant such as a mixture of chilled brine through pipes which form part of the structure of the tank. The refrigerant itself is refrigerated from a central refrigerator often situated in a vehicle depot. This freezing process can take several hours and, as mechanical refrigerators are often used, noise can be a significant problem.

The present invention seeks to address these problems and to provide improved simplicity, speed and quietness of the recharging step by substituting a liquid cryogen, such as liquid nitrogen, for the conventional mechanical refrigeration apparatus necessary to circulate a refrigerant such as brine.

SUMMERY OF THE INVENTION

Accordingly, the present invention provides a refrigeration apparatus comprising a source of liquid cryogen, a container for receiving product to be refrigerated, a plurality of discrete chilling elements positioned within the container and operable to chill any product placed within the container, supply means for supplying liquid cryogen from the source to distribution means for distributing liquid and gaseous cryogen within the container thereby lowering the temperature of the atmosphere and any product therein, characterized in that the chilling elements comprise a eutectic material and are located around the periphery of the container, and in that the distribution means includes means for bringing cryogenic vapor into heat exchange contact with said chilling elements thereby chilling said elements which may then be used to maintain a given refrigeration temperature within the container.

DETAILED DESCRIPTION OF THE INVENTION

The refrigeration apparatus of the present invention is advantageous in that it utilizes fully the chilling capacity of both liquid and gaseous cryogen. In the subject apparatus, the supply means preferably includes a supply pipe in heat exchange contact with one or more of said chilling elements thereby allowing cryogenic liquid passing through said supply pipe to chill said chilling means to a desired temperature.

Each chilling means may comprise an outer envelope containing the eutectic material and a conduit passing therethrough for the passage of the liquid cryogen, the conduit being formed of stainless steel. The chilling elements are advantageously separated from a portion of the interior of the container by a curtain which acts to define an exit flow path for waste cryogenic vapor. The chilling elements lie within said exit flow path and thereby adsorb any remaining chilling capacity from said waste cryogenic vapor. The chilling elements may be mounted on the walls and/or ceiling of said container, and the curtain extends from an upper portion of the container interior towards the floor thereof but stops short thereof thereby defining a gap through which waste cryogenic vapor can escape from the container.

The distribution means may comprise a plurality of spray nozzles for spraying a mist of liquid cryogen into the interior of the container. Preferably, the spray nozzles are situated towards an upper portion of the container and act to cause cryogenic vapor to descend downwardly therefrom and towards a region in which product may be stored.

The subject apparatus may include a vent towards the top of said container through which waste cryogenic vapor can be vented to the atmosphere. Preferably, the apparatus also includes a temperature sensor for sensing the temperature of cryogenic liquid, which may be at least partially vaporized, downstream of the chilling elements and control means preferably connected to said sensor for terminating flow of cryogenic liquid to said chilling elements upon detection of a pre-determined temperature.

Figure 1:
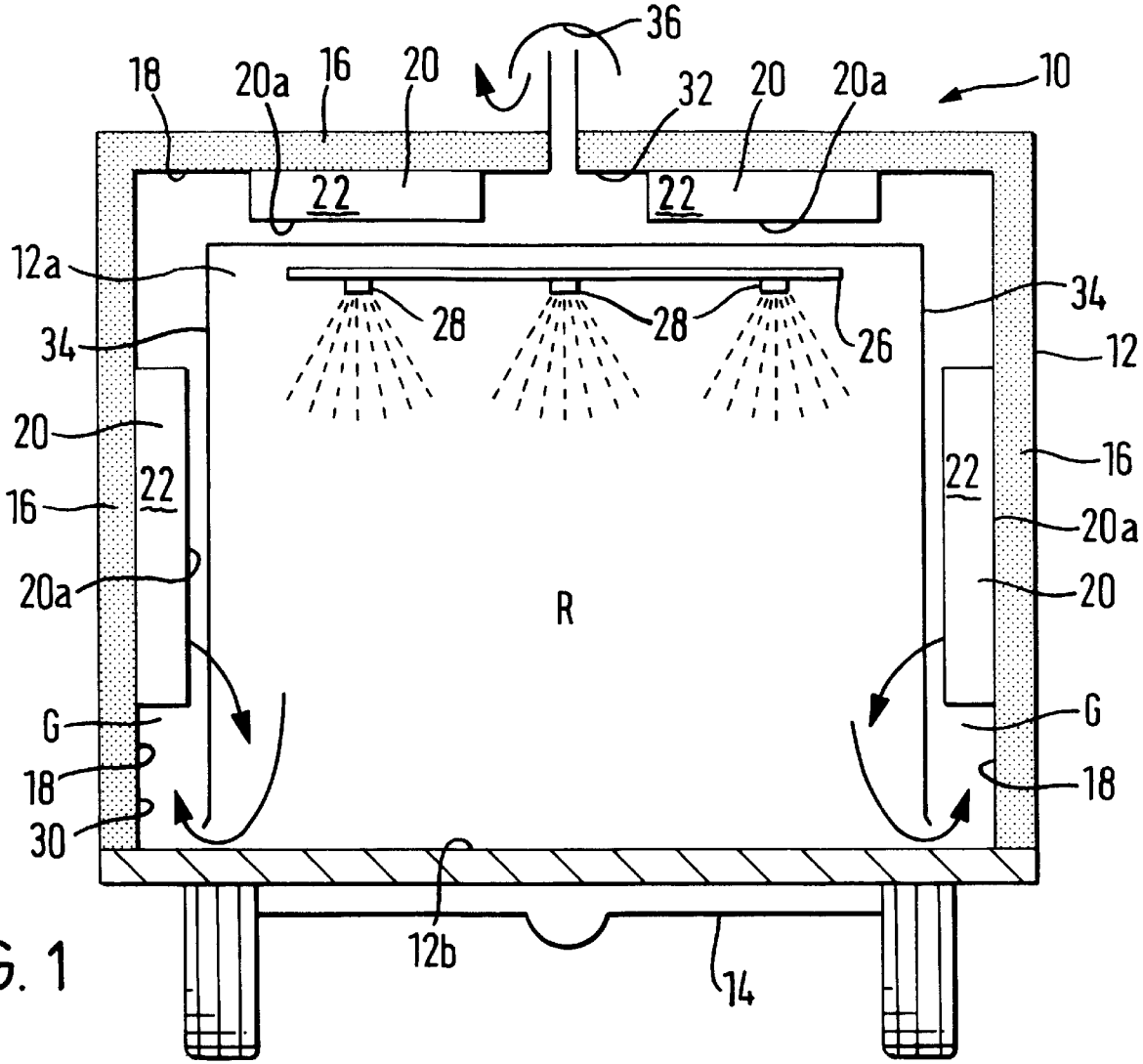
FIG. 1 is a cross sectional view of a vehicle incorporating the present invention.
Figure 2:
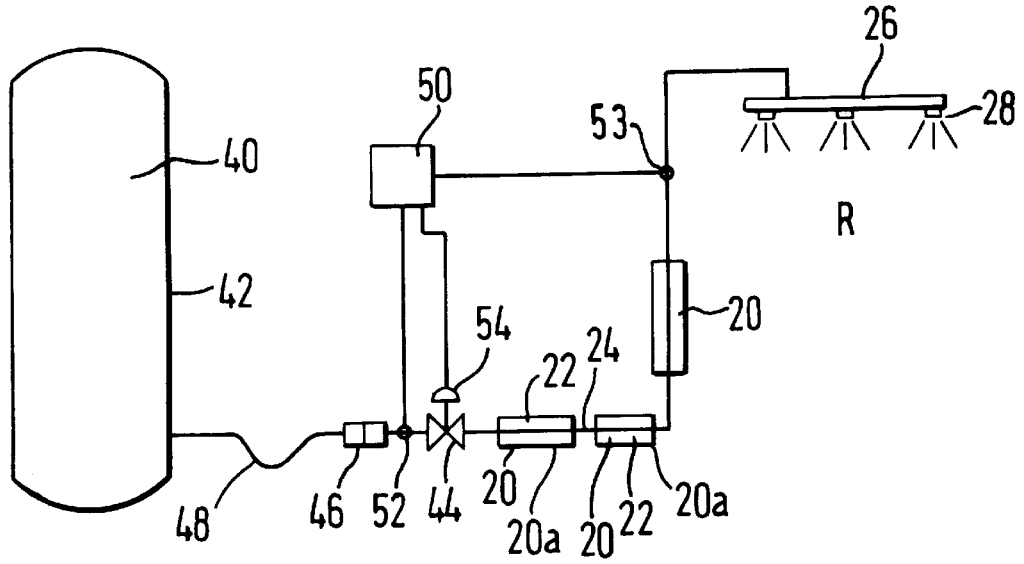
FIG. 2 is a schematic representation of various features of the present invention.

The present invention will now be more particularly described by way of example and with reference to the accompanying drawings, wherein FIG. 1 illustrates a refrigeration apparatus 10 comprising a container 12 situated on, for example, a truck chassis 14. The container 12 is provided with thermal insulation or lagging as shown at 16 and an inner surface 18 upon which a plurality of chilling elements 20 are mounted. Each of these chilling elements 20 are formed of an outer metal jacket 20*a* which encases a quantity of eutectic material 22. The eutectic is a mixture which freezes or melts at a constant temperature of, for example, about minus 20° C. While a number of eutectic materials are known, liquids such as brine are comparatively inexpensive and therefore readily present themselves for use in the present invention. As illustrated in FIG. 2, a cryogen supply pipe, or conduit, 24 is provided through the center of each chilling element 20. Conduit 24 can, if desired, be routed through the brine in each chilling element 20 several times before passing away into a further chilling element or elements before being directed to spray bar 26 situated towards an uppermost region of the container.

A plurality of nozzles 28 are provided on spray bar 26 and each acts to create a mist or spray of cryogenic liquid which descends downwardly from the spray bar and into region R in FIG. 1 in which products to be refrigerated are to be stored. As shown in FIG. 1, the chilling elements 20 are preferably mounted on the inner wall 18 of container 12 as such a position allows any chilling effect created thereby to create a convection current causing cold or chilled atmosphere to descend downwardly towards a bottom region R of the container in which any product to be refrigerated will naturally be positioned. In the particular arrangement of FIG. 1, chilling elements 20 are positioned on side walls 30 and roof portion 32, respectively. Such positioning helps enhance the chilling effect as chilled air has a much longer path through the container than might be possible with chilling elements positioned in the floor space or closer to the bottom of the container. A curtain 34 is provided to divide the chilling elements 20 from region R and thereby define a gap through which spent cryogenic vapor can escape from the container. In operation, spent cryogen will pass over the outer surfaces of eutectic chillers 20 and impart a further chilling effect before passing upwardly towards a vent 36 from which it will escape the container 12. As shown, curtain 34 extends from an upper portion of the container 12*a* downwardly towards the base 12*b* thereof, but terminates just short thereof in order to create a lower gap through which spent cryogenic vapor can escape.

Referring now to FIG. 2, it will be appreciated that a source of liquid cryogen such as, for example, liquid nitrogen will be required for the performance and operation of the present invention. In practice, such cryogenic liquid 40 may be stored in a storage vessel 42 situated either on the vehicle itself or at the vehicle's depot. If the first of these arrangements is adopted, then the vessel is coupled directly to a control valve 44 employed to control the flow of liquid cryogen 40 to supply pipe 24 which passes through chilling elements 20 and on to spray bar 26. Alternatively, if the latter of these two arrangements is adopted then a coupling device shown at 46 is employed together with a flexible supply pipe 48 to link vessel 42 to supply pipe 24 upstream of valve 44. A control apparatus shown schematically at 50 is operably linked to temperature sensors 52 and 53 situated upstream and downstream, respectively, of chilling elements 20 and to actuator 54 of control valve 44.

In operation, temperature sensor 53 is employed to monitor the temperature of cryogenic liquid exiting the last of the chilling elements 20 and provide a signal to controller 50 indicative of the temperature thereat. Controller 50 is employed to compare this temperature with that of the incoming liquid 40 and terminate liquid supply once the exit temperature at sensor 53 is equal to or substantially equal to the inlet temperature at sensor 52. After this point, there is little if any benefit from supplying further liquid cryogen 40 to freeze chilling elements 20. Flow may, however, be continued if it is desired to further chill the interior of the container by gaseous phase of the liquid cryogen 40, or to provide a boost to the chilling effect during periods when, for example, the container door (not shown) is open and chilling atmosphere escapes therefrom. It will, of course, be appreciated that any liquid cryogen 40 that passes through the chilling elements 20 will eventually exit the spray bar 26 via nozzles 28 and act in the gaseous phase to chill the atmosphere within the interior of the container 12. This chilling effect assists in the rapid creation of a chilled atmosphere suitable for receiving products to be kept at sub-ambient temperatures.

Figure 3:
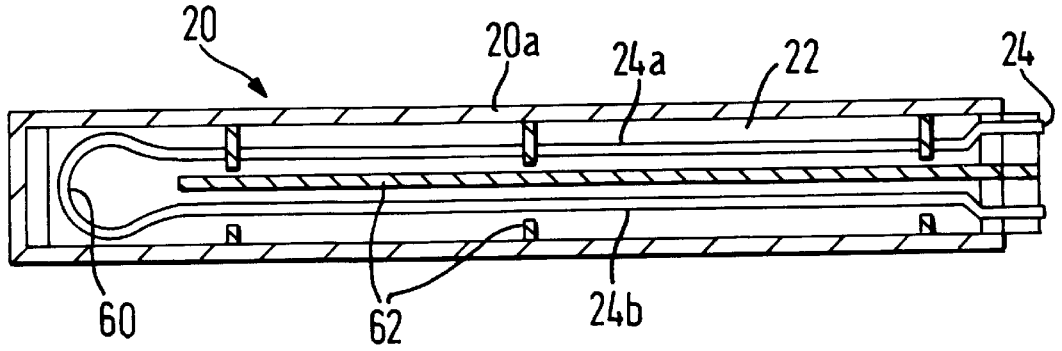
FIG. 3 is a cross sectional view of a eutectic chilling device.

The chilling element 20 shown in FIG. 3 comprises a seam welded outer jacket, or envelope, 20*a* of stainless steel containing the eutectic material 22, and the conduit 24 passes twice along the length of the element 20, forming a 180° bend 60 therein. The bend 60 is deliberately of a diameter greater than the distance between the two adjacent lengths 24*a*, 24*b* of conduit, so as to minimize the effect of thermal stresses caused by passing the liquid cryogen 40 therethrough. Similarly, the conduit is supported within the envelope 20*a* by support members 62, and the conduit 24 is formed of stainless steel which has an advantageous compromise of mechanical and thermal (heat transfer) characteristics at the very low temperatures encountered when the cryogen passed therethrough is liquid nitrogen.

Figure 4A:
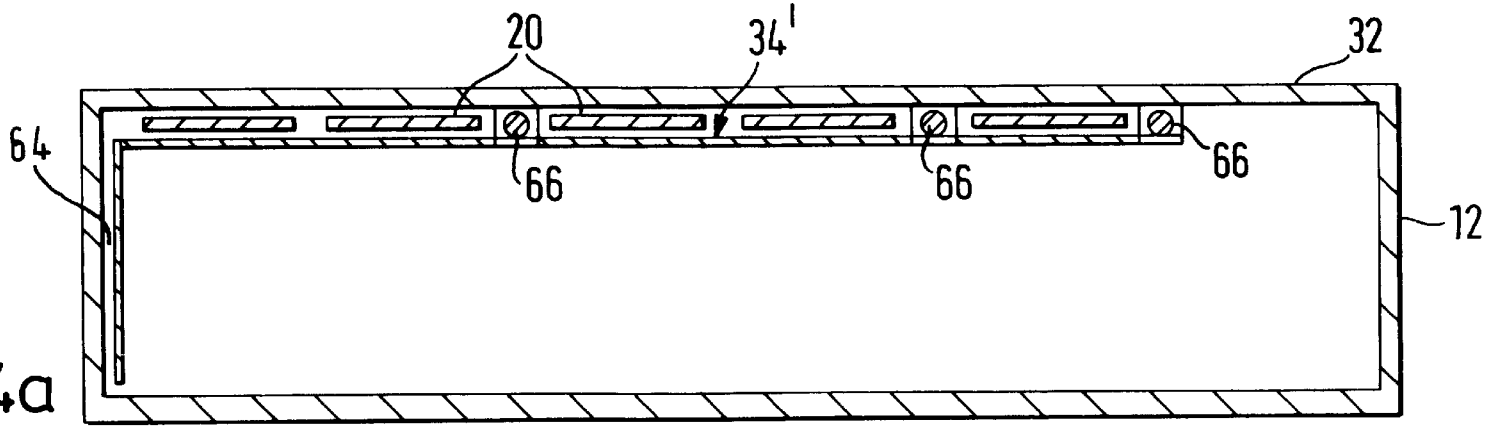
FIGS. 4*a* and 4*b* are cross sectional side elevation and plan views, respectively, of an alternative arrangement for the chiller elements in the vehicle of FIG. 1.
Figure 4B:
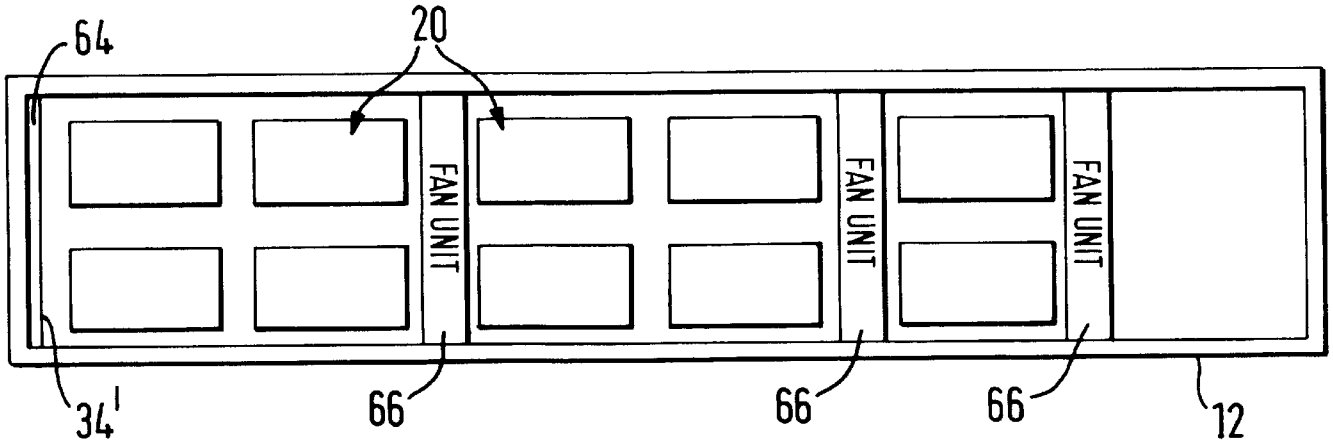

FIGS. 4*a* and 4*b* show an alternative arrangement for the chilling elements in the vehicle of FIG. 1. Ten chilling elements 20 are located adjacent the roof 32 of the container 12 and a false ceiling and curtain 34' form a drip tray for condensation falling from the chilling elements 20 and an air duct 64. Fan units 66 are provided to draw warmer air from upper portion of the container 12, to flow over the chiller elements 20, down the duct 64 and back into the container. Such an arrangement has the advantage that the fans 66 do not seize through contact with the very cold air chilled by contact with the chiller elements 20. The disposition of the chiller elements 20 in the embodiment of FIGS. 4*a* and 4*b* advantageously maximizes the useable space within the container 12. The cryogen spray means (not shown in FIGS. 4*a* and 4*b*) is preferably located near the roof of the container, such as along the juncture of the false ceiling 34' and the side walls of the container.

From the above, it will be appreciated that the use of liquid cryogen 40 to freeze the eutectic will significantly reduce the freezing time and allow vehicles to be returned to operation much more rapidly than is presently possible. In addition, by spraying the spent cryogen into the interior of the container rather than, for example, venting it to atmosphere, it is possible to create rapidly an atmosphere suitable for receiving produce to be refrigerated. Produce might therefore be loaded while the chillers are still being frozen down, thereby further reducing the turn round time of the vehicle. A further and possibly more significant advantage resides in the fact that the process is extremely quiet by comparison with presently known techniques which typically employ noisy mechanical refrigeration apparatus. Consequently, operation can be undertaken in areas where excessive noise is not permitted.

While the above apparatus has been described with reference to a vehicle, it will be appreciated that the container could be of any form such as ,for example, a portable or static unit of somewhat smaller dimensions supplied to a customer for short or long term use. Such containers could be used to supplement or replace existing cold rooms or stores and are particularly useful if other systems are being maintained or have broken down.

We claim:

1. A refrigeration apparatus comprising: a source of liquid cryogen; a container for receiving product to be refrigerated; a plurality of discrete chilling elements positioned within the container and operable to chill any product placed within the container; supply means for supplying liquid cryogen from the source to distribution means for distributing liquid cryogen within the container to thereby lower the temperature of the atmosphere and any product therein, characterized in that the chilling elements comprise a eutectic material and are located around the periphery of the container, in that the distribution means includes means for bringing cryogenic vapor into heat exchange contact with said chilling elements thereby chilling said elements, and in that the supply means includes a supply pipe in heat exchange contact with one or more of the eutectic chilling elements thereby allowing cryogenic liquid passing through the supply pipe to chill the chilling elements to a desired temperature.

2. A refrigeration apparatus in accordance with claim 1, wherein said distribution means comprises a plurality of spray nozzles for spraying a mist of liquid cryogen into the interior of the container.

3. A refrigeration apparatus in accordance with claim 2, wherein said spray nozzles are situated towards an upper portion of the container and act to cause cryogenic vapor to descend downwardly therefrom and towards a region in which product may be stored.

4. A refrigeration apparatus in accordance with claim 1, wherein said chilling elements are separated from a portion of the interior of the container by a curtain which defines an exit flow path for waste cryogenic vapor and said chilling elements lie within said exit flow path and thereby absorb any remaining chilling capacity from said waste cryogenic vapor.

5. A refrigeration apparatus in accordance with claim 4, wherein said chilling elements are mounted on the walls and/or ceiling of said container and the curtain extends from an upper portion of said container interior towards the floor thereof but stops short thereof thereby defining a gap through which waste cryogenic vapor can escape from the container.

6. A refrigeration apparatus in accordance with claim 1, including a vent towards the top of said container through which waste cryogenic vapor may be vented to atmosphere.

7. A refrigeration apparatus in accordance with claim 1, wherein the chilling elements each comprise an outer envelope containing the eutectic material and a conduit passing therethrough for the passage of the liquid cryogen, wherein the conduit is formed of stainless steel.

8. A refrigeration apparatus in accordance with claim 1, including a temperature sensor for sensing the temperature of cryogenic liquid downstream of the chilling elements and control means operably connected to said sensor for terminating flow of cryogenic liquid to said chilling elements upon detection of a pre-determined temperature.

9. A refrigeration apparatus in accordance with claim 8, wherein each conduit extends longitudinal at least twice along a major longitudinal dimension of the chiller element and thus forms at least one approximately 180° bend, wherein each such bend is of greater diameter than the distance between two adjacent longitudinal extensions of conduit.

10. A refrigeration apparatus in accordance with claim 1 additionally comprising one or more fan units mounted closely adjacent the roof of the container and adapted to draw in warmer air from adjacent the roof of the container and to expel said air adjacent the floor of the container.

* * * * *